US010014619B2

(12) United States Patent
Haspel et al.

(10) Patent No.: US 10,014,619 B2
(45) Date of Patent: Jul. 3, 2018

(54) ANGLE CONNECTOR

(71) Applicant: Mitsumi Electronics Europe GmbH, Langen (DE)

(72) Inventors: Michael Haspel, Sulzbach (DE); Sadik Karatas, Cologne (DE); Satoshi Aoki, Frankfurt am Main (DE)

(73) Assignee: Mitsumi Electronics Europe GmbH, Langen (DE)

( * ) Notice: Subject to any disclaimer, the term of this patent is extended or adjusted under 35 U.S.C. 154(b) by 0 days.

(21) Appl. No.: 15/563,141

(22) PCT Filed: Mar. 30, 2016

(86) PCT No.: PCT/EP2016/056902

§ 371 (c)(1),
(2) Date: Sep. 29, 2017

(87) PCT Pub. No.: WO2016/156385

PCT Pub. Date: Oct. 6, 2016

(65) Prior Publication Data

US 2018/0097309 A1 Apr. 5, 2018

(30) Foreign Application Priority Data

Apr. 1, 2015 (DE) ..... 10 2015 105 088

(51) Int. Cl.
*H01R 4/18* (2006.01)
*H01R 43/00* (2006.01)
(Continued)

(52) U.S. Cl.
CPC ..... *H01R 13/506* (2013.01); *H01R 4/18* (2013.01); *H01R 13/42* (2013.01); *H01R 24/545* (2013.01); *H01R 2107/00* (2013.01)

(58) Field of Classification Search
CPC ..... H01R 43/00; H01R 9/03; H01R 13/40; H01R 13/424
See application file for complete search history.

(56) References Cited

U.S. PATENT DOCUMENTS 6,764,350 B2 7/2004 Kosmala
6,817,899 B1 * 11/2004 Zerebilov ..... H01R 9/0524 439/582
(Continued)

FOREIGN PATENT DOCUMENTS

DE 4011958 A1 11/1991
DE 102010039314 A1 2/2012
(Continued)

OTHER PUBLICATIONS

International Preliminary Report on Patentability issued for PCT/EP2016/056902 dated Jul. 6, 2017, pp. 1-14.
(Continued)

*Primary Examiner* — Briggitte R Hammond
(74) *Attorney, Agent, or Firm* — Steven M. Shape; Dennemeyer & Associates, LLC

(57) ABSTRACT

The invention relates to a high-frequency angle connector comprising an external connector (100), an angled external conductor (110), an angled insulator (120), an angled holder (130) and four angled contacts (140) to which electrical conductors can be connected. The angled holder (130) is designed such that the four contacts (140) can be inserted without exerting force. The high-frequency angle connector is preferably a FAKRA connector. The housing (100) of a FAKRA connector corresponds to the DIN 72594-1 standard.

8 Claims, 3 Drawing Sheets

(51) Int. Cl.

| | |
|---|---|
| ***H01R 9/03*** | (2006.01) |
| ***H01R 13/506*** | (2006.01) |
| ***H01R 24/54*** | (2011.01) |
| ***H01R 13/42*** | (2006.01) |
| *H01R 107/00* | (2006.01) |

(56) References Cited

U.S. PATENT DOCUMENTS

| | | | | |
|---|---|---|---|---|
| 7,044,789 | B2 * | 5/2006 | Yohn | H01R 9/037 439/599 |
| 7,494,377 | B2 * | 2/2009 | Yohn | H01R 9/03 439/460 |
| 8,439,691 | B1 | 5/2013 | Lan | |
| 9,130,295 | B2 * | 9/2015 | Nguyen Nhu | H01R 13/447 |
| 9,837,761 | B1 * | 12/2017 | Hardy | H01R 13/6272 |
| 2003/0199205 | A1 | 10/2003 | Kosmala | |
| 2004/0038591 | A1 * | 2/2004 | Clement | H01R 9/035 439/607.08 |
| 2010/0081344 | A1 * | 4/2010 | Gleissner | H01R 13/42 439/729 |
| 2015/0236435 | A1 * | 8/2015 | Hardy | H01R 9/05 439/578 |

FOREIGN PATENT DOCUMENTS

| | | | |
|---|---|---|---|
| DE | 202012010451 | U1 | 1/2013 |
| EP | 2658037 | A1 | 3/2016 |
| EP | 1517406 | A1 | 8/2016 |

OTHER PUBLICATIONS

DIN 72594-1 "Road Vehicles—50 ohm radio frequency interface—Part 1: General requirements," Jul. 2006, pp. 1-12.

* cited by examiner

ANGLE CONNECTOR

FIELD OF THE INVENTION

The invention relates to a high-frequency angle connector, in particular a high-frequency angle connector for a FAKRA plug-in connection, with an external connector, an angled external conductor part that is received in the external connector, an angled insulating part that is received in the external conductor part, an angled holder and four angled contact elements, to which electrical conductors can be connected.

Prior Art

In 2004 the vehicle standards committee (FAKRA, FAch-KReis Automobiltechnik [Expert Group on Automobile Technology]) passed the DIN 72594-1 standard which describes high-frequency connectors to be used in the automotive sector. There are special requirements in the automotive sector, for example with respect to temperature conditions, humidity and vibrations. FAKRA connectors are used for data transmission cables in automotive engineering.

The mechanical dimensions of such FAKRA connectors are specified in the version of October 2004 of the DIN standard 72594-1. The section "Straßenfahrzeuge—50-Ohm-Hochfrequenz-Schnittstelle (50-Ω-HFSSt) [Road vehicles—50 Ohm High-Frequency Interface (50-Ω-HF-SSt])—Part 1: "Male and elektrische Anforderungen" (Dimensions and Electrical Requirements) of the aforementioned DIN standard 72594-1 specifies connector and socket or respectively coupling of an interface with an impedance of 50 Ohm for high frequency applications (50-Ω-HFSSt) in road vehicles.

In prior FAKRA angle connectors the amount of force required during assembly could damage or bend the contact elements which is disadvantageous. The connection of the conductors to the contact elements could also be damaged thereby.

Object

The object of the invention is to provide a high-frequency angle connector that has a reduced risk of damaging the contact elements during assembly.

Solution

This object is achieved by the subject matter of the independent claim. Advantageous developments of the subject matter of the independent claim are characterised in the sub-claims. The wording of all claims is hereby incorporated into this description by reference.

Proposed as a solution to the object is a high-frequency angle connector with an external connector. The high-frequency angle connector includes an angled external conductor part that is received in the external connector. Also received in the external conductor part is an angled insulating part. In addition, there are an angled holder and four angled contact elements, each of which can be connected to an electrical conductor. These four angled contact elements are received in a predetermined position in the holder.

The holder is designed such that the four contact elements can be inserted vertically to the plane that is defined by the angle of the holder, without exerting force. Thus the contact elements are inserted laterally: two from one side and two from the other side. The holder with the contact elements is received in the angled insulating part. In this case, the holder or the insulating part can have recesses which, using corresponding latch noses, latch onto each other when the parts are assembled. The angle between the connection direction of the electrical conductors and the direction of the connection, which is specified by the external connector, is typically 90°. However, other, angles, including larger angles, are possible.

As a connector, the high-frequency angle connector can be optionally configured as a connector (male) or as a coupling (female), wherein both configurations differ above all in the special shape of the contact elements.

Due to the angled shape of the holder, the contact elements, having been inserted into the holder from the side without exerting force, are fastened without exerting elastic forces when the holder is received in the angled insulating part. This reduces the risk of the contact elements being damaged during assembly of the high-frequency angle connector.

In order for the holder to be introduced into the insulating part particularly easily and without tilting, the holder has noses vertically to the plane that is defined by the angle of the holder, which extend into recesses of the insulating part.

To facilitate inserting and fastening the contact elements, the holder has guides for the contact elements. These guides contain noses and the contact elements have recesses which receive the noses in the guides when the contact elements are inserted into the holder. This is particularly advantageous if the angle connector has a significantly larger angle than 90° between the connection direction of the electrical conductors and the direction of the connection.

In the case when every two contact elements positioned on the same side of the plane that is defined by the angle of the holder are connected to each other by insulating blocks, assembling the angle connector is further simplified. In particular, inserting the contact elements into the holder then becomes easier.

To ensure a smooth assembly, it should be possible to connect the contact elements to the electrical conductors by means of crimp connections.

Further details and features become apparent from the following description of preferred exemplary embodiments in connection with the claims. In this case, each feature can be realised in its own right or by a plurality in combination with each other. The options for achieving the object are not limited to the exemplary embodiments. Hence, for example, statements about range specifications always include all the unmentioned and intermediate values and all the conceivable partial intervals.

The figures show diagrams of an exemplary embodiment. In detail they show:

Figure 1:
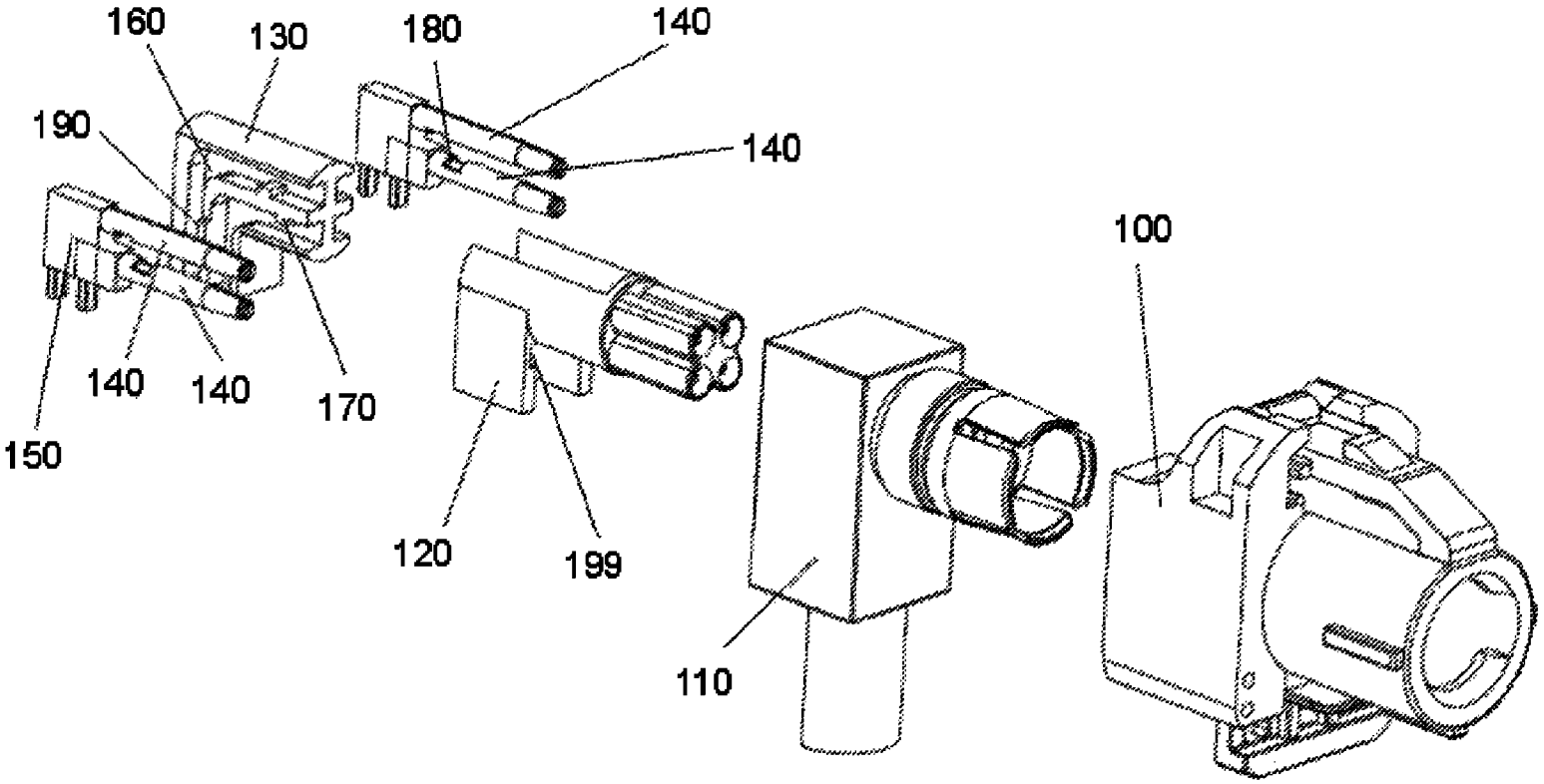
FIG. 1 shows a preferred embodiment of a high-frequency angle connector in an exploded view.

FIG. 1 shows a high-frequency angle connector according to the invention in an exploded view. This angle connector can comprise an external connector or a FAKRA housing 100. The FAKRA housing complies with the DIN 72594-1 standard. This male high-frequency angle connector can form an electrical plug-in connection with a female socket. Alternatively, it can be configured as a female high-frequency angle coupling which can form an electrical plug-in connection with a male built-in connector. For this, a different form of contact element can be selected.

The high-frequency angle connector comprises an angled external conductor 110, an angled insulator 120, an angled holder 130 and four angled contacts 140. The four contacts can each be connected to an electrical conductor, preferably by a crimp connection.

Every two contacts 140 positioned on the same side of the plane that is defined by the angle of the holder 130, can be connected to each other by insulating blocks 150.

In addition, the holder 130 can comprise guides 160 for the contacts. The four contacts 140 can be inserted laterally into the guides 160 in the holder 130, and in particular without exerting force. If every two contacts 140 are connected to each other by insulating blocks 150, they are inserted together, which makes handling them easier.

In the guides 160 are noses 170, and the contacts 140 have corresponding recesses 180 which can receive noses 170 when the contacts 140 are inserted into the holder 130.

In addition, the holder 130 can have noses 190 vertically to the plane that is defined by the angle of the holder. Noses 190 can extend into recesses 199 of the insulator 120.

The holder 130 with the contacts 140 can then be slid into the insulator 120 which is then inserted into the external conductor 110 which can in turn be slid into the external connector 100.

Figure 2:
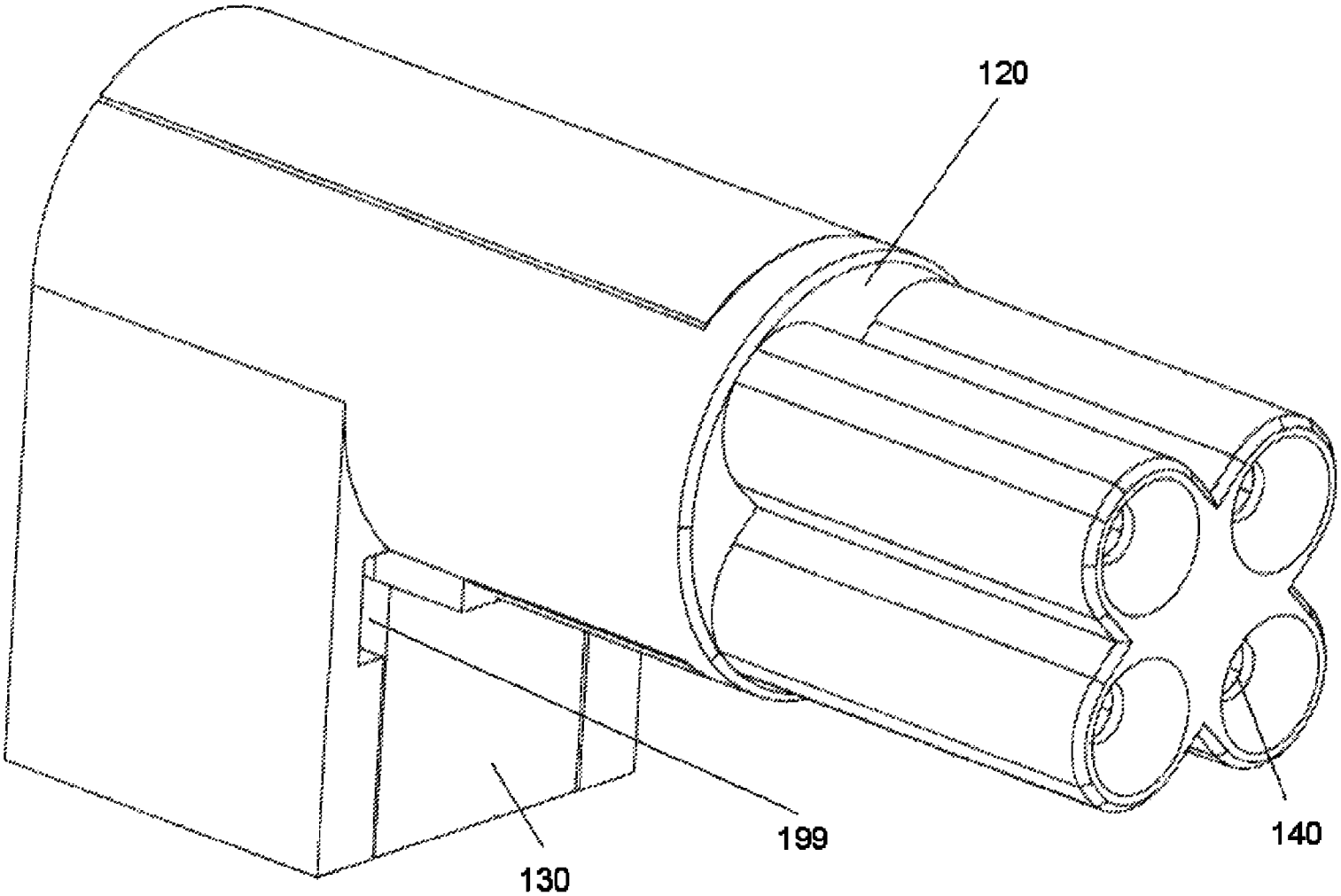
FIG. 2 shows a partial view of the embodiment according to FIG. 1, wherein the partial view shows the insulator and the holder with the contact elements when assembled.

FIG. 2 shows the insulating part 120, into which the holder 130 has been inserted with the contacts 140. Noses 190, which can be formed in or otherwised comprised by holder 130, may extend into recesses 190, as can be seen particularly clearly in FIG. 2.

Figure 3:
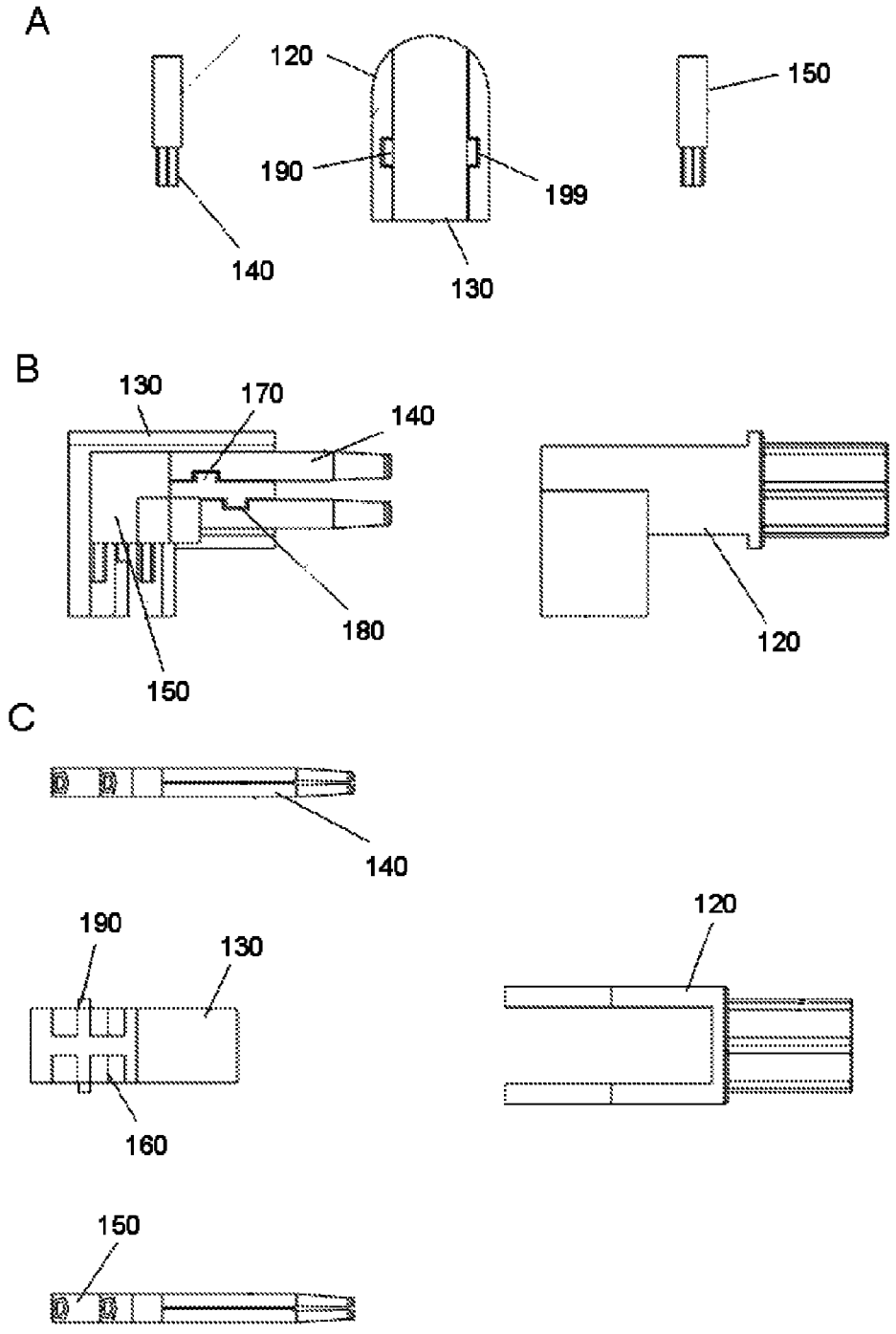
FIG. 3A shows a rear view of the contact elements, the holder and the insulator.
FIG. 3B shows a side view of the contact elements, the holder and the insulator.
FIG. 3C shows a top view of the contact elements, the holder and the insulator respectively prior to assembly.

FIGS. 3A, 3B and 3C show contacts 140, the holder 130 and the insulating part 120 prior to assembly. FIG. 3A shows a rear view, that is, from the side opposite the connection, whereas FIG. 3B shows a side view and FIG. 3C a top view. Apparent here is how the contacts 140, which can be connected to insulating blocks 150, fit into the holder 130 and the holder fits into the insulator 120. Particularly apparent is how the contacts 140 fit into the guide 160 in the holder 130, wherein the noses 170 fit exactly into the recesses 180 in the contacts. As can also be seen in FIGS. 3A, 3B and 3C, noses 190 on the holder 130 can fit into the recesses 199 of the insulator 120.

Glossary

Crimping

Crimping means a joining process during which two components are connected with each other by deformation, for example by deburring, squashing, gathering or folding. A crimp connection is only releasable to a limited extent and can only be renewed with a suitable tool during repairs (according to http://de.wikipedia.org/wiki/Crimpen and https://en.wikipedia.org/wiki/Crimp_(joining)).

Without Exerting Force

"Without exerting force" means without sufficient force to deform something (elastically). However, less force, for example to overcome the slight frictional forces between the holder and the insulating part, can be necessary.

At Right Angles

At right angles means at an angle of 90 degrees with a specified tolerance.

Connector and Socket

In the case of electrical plug-in connections a distinction is made between the male part of a plug-in connection (with contact pins pointing outwards) and the female part (with inward-facing contact openings). The male part is described as a connector when it is attached to the end of a cable, or as a built-in connector when it is permanently built in to a device housing. The female part is described as a coupling when it is attached to the end of a cable, or as a socket when it is permanently built in to a device housing. Flat connectors, which are squeezed on the wires of the cable harness as cable shoes in a crimping or pressing process may be found both insulated and completely uninsulated, and may be routinely used both for connections routing mains voltage within electrical devices and in the motor vehicle sector.

Plug-in Connector

Plug-in connectors serve to separate and connect cables (for electric current or optical radiation, technical media in general). In this case, the parts of the connection are suitably adjusted by interlocking the connector parts, releasably fastened by spring force in a non-positive connection and often are additionally secured against unintentional release by means of bolting. (according to http://de.wikipedia.org/wiki/Steckverbinder and https://en.wikipedia.org/wiki/Electrical_connector)

Angle Connector

In this case this is a plug-in connector which is typically angled at approximately 90°. The direction of the connection is therefore arranged at right angles to the cable. Although described as an angle connector, the angled plug-in connector can be available either as a connector (male) to connect to a socket or as a coupling (female) to connect to a built-in connector.

LIST OF REFERENCE NUMBERS

100 external connector
110 angled external conductor
120 angled insulator
130 angled holder
140 angled contact element
150 insulating block
160 guide for contact elements
170 nose in guide
180 recess in contact element
190 nose
199 recess in insulator

LITERATURE CITED

Non-Patent Literature Cited

DIN 72594-1 standard

The invention claimed is:

1. A high-frequency angle connector comprising:

an external connector (100);

an angled external conductor (110) which is received in the external connector (100);

an angled insulator (120) which is received in the external conductor (110);

an angled holder (130) separated from the insulator (120);

four angled contacts (140), each of which can be connected to an electrical conductor;

wherein the four angled contacts (140) are received in a predetermined position in the holder (130);

wherein the holder (130) includes guides (160) for the contacts (140), and noses (170) in the guides, and wherein the contacts (140) have recesses (180), which receive the noses (170) in the guides (160) of the holder (130) when the four angled contacts (140) are inserted into the holder (130); and wherein the guides (160) are designed such that the four angled contacts (140) can be inserted into the holder (130) vertically to the plane that is defined by the angle of the holder, without exerting elastic forces; and wherein the holder (130) is received in the angled insulator (120).

2. The high-frequency angle connector of, claim 1 wherein insulator (120) includes recesses (199) and holder (130) comprises noses (190) vertically to the plane that is defined by the angle of the holder, which are extendable into recesses (199) of insulator (120) when holder (130) is moved into insulator (120).

3. The high-frequency angle connector, of claim 1 wherein every two contacts (140), positioned on the same side of the plane that is defined by the angle of the holder (130), are connected to each other by insulating blocks (150).

4. The high-frequency angle connector of claim 1 wherein the contacts (140) are connectable to the electrical conductor by crimp connections.

5. The high-frequency angle connector claim 2 wherein every two contacts (140), positioned on the same side of the plane that is defined by the angle of holder (130), are connected to each other by insulating blocks (150).

6. The high-frequency angle connector according claim 2 wherein the contacts (140) are connectable to the electrical conductor by crimp connections.

7. The high-frequency angle connector according claim 3 wherein the contacts (140) are connectable to the electrical conductor by crimp connections.

8. The high-frequency angle connector according claim 5 wherein the contacts (140) are connectable to the electrical conductor by crimp connections.

* * * * *